US012644684B2

(12) United States Patent
Dunnam

(10) Patent No.: US 12,644,684 B2
(45) Date of Patent: Jun. 2, 2026

(54) AMMUNITION CARTRIDGE

(71) Applicant: James Dunnam, Austin, TX (US)

(72) Inventor: James Dunnam, Austin, TX (US)

( * ) Notice: Subject to any disclaimer, the term of this patent is extended or adjusted under 35 U.S.C. 154(b) by 0 days.

(21) Appl. No.: 18/823,670

(22) Filed: Sep. 3, 2024

(65) Prior Publication Data

US 2024/0426585 A1 Dec. 26, 2024

Related U.S. Application Data

(63) Continuation of application No. 18/450,392, filed on Aug. 15, 2023, now Pat. No. 12,078,464, which is a continuation of application No. 17/862,400, filed on Jul. 11, 2022, now Pat. No. 11,725,915, which is a continuation of application No. 16/579,784, filed on Sep. 23, 2019, now Pat. No. 11,385,034, which is a continuation of application No. 16/035,608, filed on Aug. 22, 2018, now Pat. No. 10,422,610, which is a continuation of application No. 15/601,865, filed on May 22, 2017, now Pat. No. 10,024,638, which is a continuation of application No. 15/409,520, filed on Jan. 18, 2017, now Pat. No. 9,658,038.

(51) Int. Cl.

| | |
|---|---|
| ***F42B 7/02*** | (2006.01) |
| ***F42B 7/08*** | (2006.01) |
| ***F42B 8/02*** | (2006.01) |

(52) U.S. Cl.
CPC ..... *F42B 7/02* (2013.01); *F42B 7/08* (2013.01); *F42B 8/02* (2013.01)

(58) Field of Classification Search
CPC ..... F42B 7/02; F42B 7/08; F42B 8/02
USPC ..... 102/470
See application file for complete search history.

(56) References Cited

U.S. PATENT DOCUMENTS

| | | | | |
|---|---|---|---|---|
| 3,269,311 A * | 8/1966 | Comerford | ..... | F42B 7/04 102/451 |
| 10,422,610 B2 * | 9/2019 | Dunnam | ..... | F42B 8/02 |

* cited by examiner

*Primary Examiner* — Samir Abdosh
(74) *Attorney, Agent, or Firm* — Michael G. Smith, Esq.

(57) ABSTRACT

Systems, methods and apparatus are provided through which in some implementations an ammunition cartridge includes a cartridge casing having a longitudinal center axis, a powder pocket positioned adjacent to the cartridge casing, a piston bore positioned adjacent to the powder pocket, a piston in the piston bore, and a payload bay positioned adjacent to the payload bay, wherein the piston is not coupled to the cartridge, wherein the piston is in contact with the payload bay wherein a diameter of the powder pocket is less than an inside diameter of the cartridge casing to provide a reduced velocity to the payload.

18 Claims, 14 Drawing Sheets

AMMUNITION CARTRIDGE

RELATED APPLICATION

This application is a continuation of, and claims the benefit and priority under 35 U.S.C. 120 of U.S. Original patent application Ser. No. 18/450,392 filed 15 Aug. 2023, which is hereby incorporated by reference in its entirety, and issued on 3 Sep. 2024 as U.S. Pat. No. 12,078,464, which is a continuation of, and claims the benefit and priority under 35 U.S.C. 120 of U.S. Original patent application Ser. No. 17/862,400 filed 11 Jul. 2022, which is hereby incorporated by reference in its entirety, and issued on 15 Aug. 2023 as U.S. Pat. No. 11,725,915, which is a continuation of, and claims the benefit and priority under 35 U.S.C. 120 of U.S. Original patent application Ser. No. 16/579,784 filed 23 Sep. 2019, which is hereby incorporated by reference in its entirety, and issued on 11 Jul. 2022 as U.S. Pat. No. 11,385,034, which is a continuation of, and claims the benefit and priority under 35 U.S.C. 120 of U.S. Original patent application Ser. No. 16/035,608 filed 14 Jul. 2018, which is hereby incorporated by reference in its entirety, and issued on 24 Sep. 2019 as U.S. Pat. No. 10,422,610, which is a continuation of, and claims the benefit and priority under 35 U.S.C. 120 of U.S. Original patent application Ser. No. 15/601,865 filed 22 May 2017 and issued on 17 Jul. 2018 as U.S. Pat. No. 10,024,638, which is hereby incorporated by reference in its entirety, which is a continuation of, and claims the benefit and priority under 35 U.S.C. 120 of U.S. Original patent application Ser. No. 15/409,520 filed 1 Jan. 2017 and issued on 23 May 2017 as U.S. Pat. No. 9,658,038, which is hereby incorporated by reference in its entirety.

FIELD

This disclosure relates generally to ammunition and more particularly to ammunition cartridges.

BACKGROUND

Many attempts at designing non lethal ammunition cartridges have been made. One such design for a 12-gauge shotgun shell includes a reduced amount of powder/propellant by a shorter length of powder/propellant that fills the cartridge casing from side-to-side. However, the 12-gauge shotgun shell has a diameter that is so large, that a reduced powder/propellant burns incompletely and inconsistently, leaving unburned powder in the barrel of the shotgun.

Another design for a non-lethal ammunition cartridge achieves non-lethality by a rearward force that activates breach block(s). For example, U.S. Pat. No. 8,485,102 includes "a hollow elongated body 50 and a rim 52 for engaging the . . . ejection mechanisms of a firearm" as shown in FIG. 6. That has the effect of causing the piston to push backwards against breach blocks.

Furthermore, U.S. Pat. No. 6,575,098 includes coupling between the moving portion of the cartridge and the cartridge, as shown by the groove 12 and the front-end portion 13 of the sabot 11 of the cartridge 11 in FIG. 3.

U.S. Pat. No. 7,930,977 has a piston that remains in the barrel of the gun.

In U.S. Pat. No. 6,250,226, pressure from detonation of a powder/propellant acts directly against the payload.

For the reasons stated above, and for other reasons stated below which will become apparent to those skilled in the art upon reading and understanding the present specification, there is a need in the art for an improved non-lethal ammunition.

BRIEF DESCRIPTION

The above-mentioned shortcomings, disadvantages and problems are addressed herein, which will be understood by reading and studying the following specification.

In yet another aspect, an ammunition cartridge includes a cartridge casing having a longitudinal center axis, a primer pocket positioned adjacent to the cartridge casing, a powder pocket positioned adjacent to the primer pocket, a powder/propellant in the powder pocket, a piston bore positioned adjacent to the powder pocket, a piston in the piston bore, and a payload bay positioned adjacent to the payload bay, wherein the piston is not coupled to the cartridge casing, wherein the piston is in direct contact with the payload bay so that pressure from powder/propellant is immediately and directly applied to the payload bay, wherein a diameter of the powder pocket is less than an inside diameter of the cartridge casing.

In another aspect, an ammunition cartridge includes a cartridge casing having a longitudinal center axis, a first end and a second end, a primer pocket positioned at the first end of the cartridge casing and positioned symmetrically along the longitudinal center axis, the primer pocket having a first end and a second end, the first end of the primer pocket being positioned at the first end of the cartridge casing, a powder pocket positioned at the second end of the primer pocket and positioned symmetrically along the longitudinal center axis, the powder pocket having a first end and a second end, the first end of the powder pocket being positioned at the second end of the primer pocket, a powder/propellant in the powder pocket, a piston bore positioned at the second end of the powder pocket and positioned symmetrically along the longitudinal center axis, the piston bore having a first end and a second end, the first end of the piston bore being positioned at the second end of the powder pocket, a piston in the piston bore, and a payload bay positioned at the second end of the payload bay and positioned symmetrically along the longitudinal center axis, payload bay having a first end and a second end, the first end of the payload bay being positioned at the second end of the piston bore, the second end of the payload bay being positioned at the second end of the cartridge casing.

In still another aspect, a method includes loading a primer into ammunition cartridge casing, loading a powder/propellant into a powder pocket and friction fitting a piston into a piston bore.

In a further aspect, a method includes detonation of a primer, the primer in a cartridge casing, the cartridge casing in a gun barrel, detonation of a powder/propellant by the detonation of a primer, the powder/propellant in the cartridge casing, the detonation causing a force, moving a piston away from the powder/propellant, the movement caused by the force, moving a payload away from the powder/propellant, the movement of the payload being variable across the full range of pressures of the cartridge, the movement of the payload being at a reduced velocity compared to conventional ammunition cartridges. In some cases, the reduced velocity is a non-lethal velocity.

Apparatus, systems, and methods of varying scope are described herein. In addition to the aspects and advantages described in this summary, further aspects and advantages will become apparent by reference to the drawings and by reading the detailed description that follows.

DETAILED DESCRIPTION

In the following detailed description, reference is made to the accompanying drawings that form a part hereof, and in which is shown by way of illustration specific implementations which may be practiced. These implementations are described in sufficient detail to enable those skilled in the art to practice the implementations, and it is to be understood that other implementations may be utilized and that logical, mechanical, electrical and other changes may be made without departing from the scope of the implementations. The following detailed description is, therefore, not to be taken in a limiting sense.

The detailed description is divided into four sections. In the first section, a system level overview is described. In the second section, apparatus of implementations are described. In the third section, implementations of methods are described. Finally, in the fourth section, a conclusion of the detailed description is provided.

System Level Overview

Figure 1:
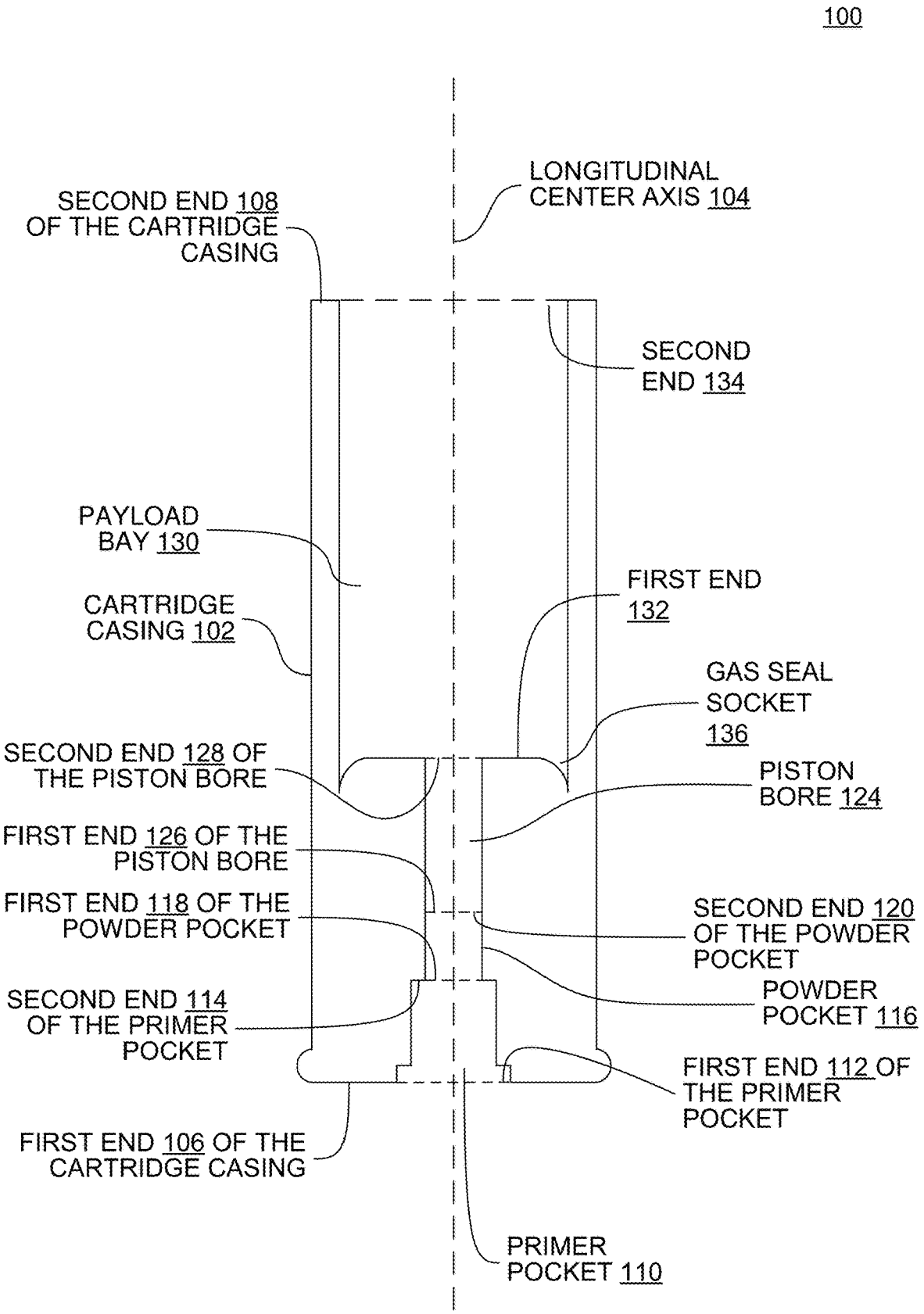
FIG. 1 is a cross section block diagram of a side view of an ammunition cartridge, according to an implementation.

FIG. 1 is a cross section block diagram of a side view of an ammunition cartridge 100, according to an implementation. The ammunition cartridge 100 includes a cartridge casing exterior 102. The cartridge casing exterior 102 has a longitudinal center axis 104, a first end 106 and a second end 108.

The ammunition cartridge 100 also includes a primer pocket 110 that is positioned at the first end 106 of the cartridge casing exterior 102. The primer pocket 110 is positioned symmetrically along the longitudinal center axis 104. The primer pocket 110 has a first end 112 and a second end 114. The first end 112 of the primer pocket 110 is positioned at the first end 106 of the cartridge casing exterior 102. The primer pocket 110 can be manufactured to support any size pistol, rifle, and shot gun primers, therefore all types of powders/propellants that are used in conjunction with small pistol, large pistol, and shot gun primers can be used.

The ammunition cartridge 100 also includes a powder pocket 116 positioned at the second end 114 of the primer pocket 110 and positioned symmetrically along the longitudinal center axis 104, the powder pocket 116 has a first end 118 and a second end 120. The first end 118 of the powder pocket 116 is positioned at the second end 114 of the primer pocket 110.

The ammunition cartridge 100 also includes a piston bore 124 that is positioned at the second end 120 of the powder pocket 116 and is positioned symmetrically along the longitudinal center axis 104. The piston bore 124 has a first end 126 and a second end 128. The first end 126 of the piston bore 124 is positioned at the second end 120 of the powder pocket 116.

The ammunition cartridge 100 also includes a payload bay 130 that is positioned at the second end 120 of the powder pocket 116 and is positioned symmetrically along the longitudinal center axis 104. The payload bay 130 has a first end 132 and a second end 134. The first end 132 of the payload bay 130 is positioned at the second end 128 of the piston bore 124. The first end 132 of the payload bay 130 includes a gas seal socket 136 The second end 134 of the payload bay 130 is positioned at the second end 108 of the cartridge casing exterior 102.

The powder pocket 116 has a smaller size than conventional powder pockets so that a smaller amount of powder/propellant is used, which is more likely to burn completely, providing more consistent burn of the powder/propellant, and allowing much lighter loads to be launched. Examples of the powder/propellant include 202 in FIGS. 2-5, 602 in FIG. 6, 702 in FIG. 7, 802 in FIGS. 8 and 902 in FIG. 9. The dimensions of the piston 200 and 300 and the piston bore control the length and power of the burn. In particular, the powder pocket 116 and the powder/propellant has a smaller diameter than conventional powder pockets, as shown in FIG. 1-9. The diameter of the powder pocket 116 and the powder/propellant is less than the inside diameter of the cartridge casing exterior 102. For example, the diameter of the powder/propellant is 5.588 mm (0.22 inch) in one implementation, which is about ⅓ of the diameter of a conventional (0.70 to 0.715 inches) 12 gauge ammunition casing internal diameter exterior 102. The smaller diameter of the powder pocket 116 and the powder/propellant produces a smaller force of detonation of the powder/propellant, than would be possible than a full diameter cartridge casing, which results in a slower speed of the payload bay 130 and the payload 304 in FIG. 3. The exact dimensions of the powder/propellant can be changed from the 0.22 inches 5.588 mm diameter and the 20 mm length in the example above to accommodate different velocities and payload weights as desired.

The cartridge casing exterior 102 is the same as conventional cartridge casings, therefore conventional ammunition manufacturing equipment can be used to manufacture the shells in FIG. 1-9, which results in economic manufacturing costs of the shells in FIG. 1-9, the only modification required is to change an injection mold at the first end 106 of the cartridge casing exterior 102 and interior dimensions are easily adapted.

While the ammunition cartridge 100 is not limited to any particular cartridge casing exterior 102 having a longitudinal center axis 104, a first end 106 and a second end 108, primer pocket 110 having a first end 112 and a second end 114, powder pocket 116 having a first end 118 and a second end 120, piston bore 124 having a first end 126 and a second end 128, payload bay 130 having a first end 132 and a second end 134, for sake of clarity a simplified cartridge casing exterior 102 having a longitudinal center axis 104, a first end 106 and a second end 108, primer pocket 110 having a first end 112 and a second end 114, powder pocket 116 having a first end 118 and a second end 120, piston bore 124 having a first end 126 and a second end 128, payload bay 130 having a first end 132 and a second end 134 are described.

Apparatus Implementations

In the previous section, a system level overview of the operation of an implementation was described. In this section, the particular apparatus of such an implementation are described by reference to a series of diagrams.

Figure 2:
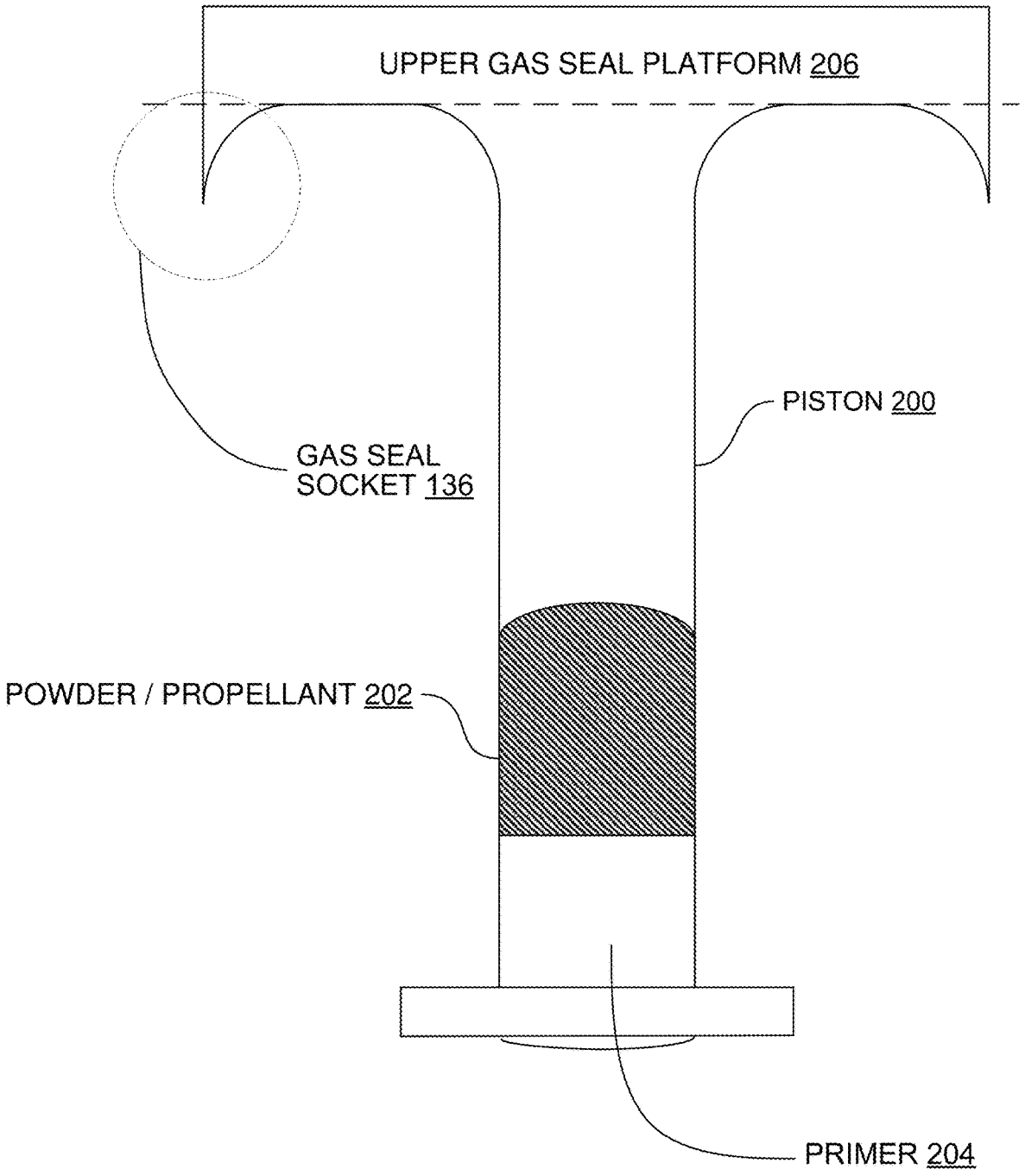
FIG. 2 is a cross section block diagram of a side view of a piston of the piston bore of the ammunition cartridge, according to an implementation.

FIG. 2 is a cross section block diagram of a side view of a piston 200 of the piston bore 124 of the ammunition cartridge 100, according to an implementation.

The piston 200 includes a powder/propellant 202 in the powder pocket 116 of FIG. 1.

The piston 200 also includes a primer 204 in the primer pocket 110 of FIG. 1 and an upper gas seal platform 206 that includes a gas seal socket 136 on both ends of the gas seal platform 206.

Figure 4:
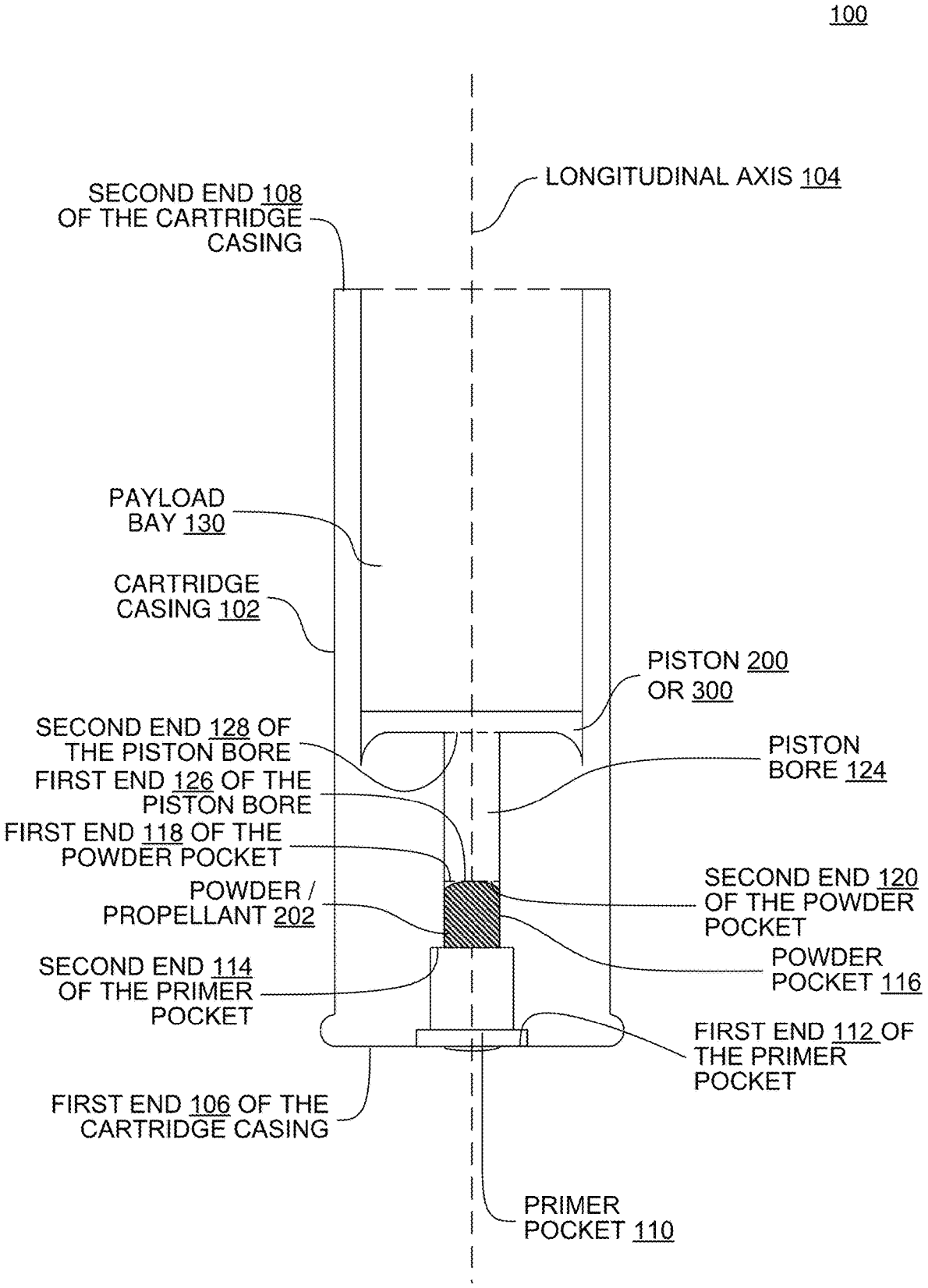
FIG. 4 is a cross section block diagram of a side view of an ammunition cartridge, according to an implementation that includes the piston in FIG. 2 or FIG. 3.

The piston 200 fits into the piston bore 124 through the second end 108 of the cartridge casing exterior 102 of the ammunition cartridge 100 in FIG. 1, as shown in FIG. 4.

Figure 3:
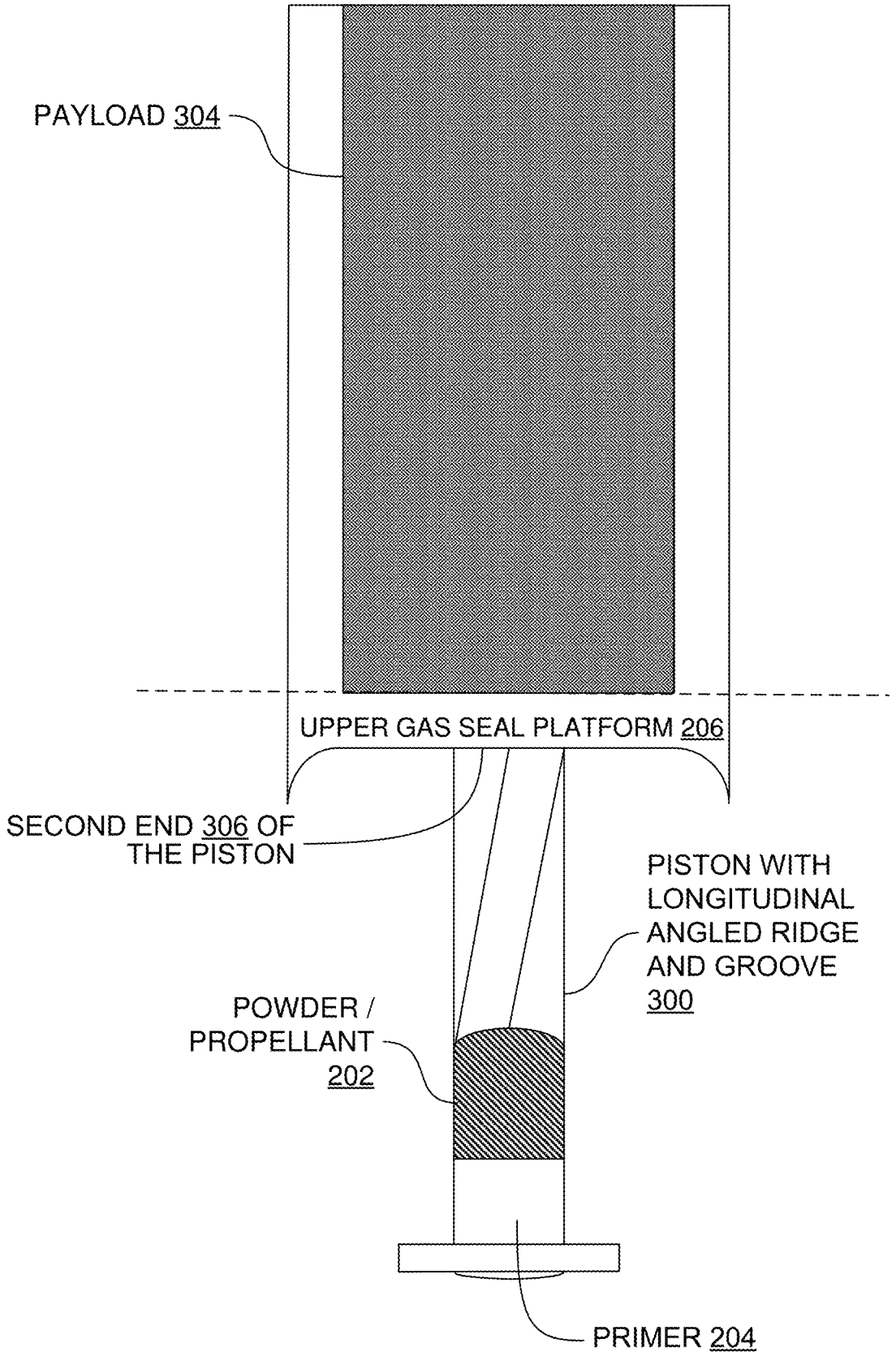
FIG. 3 is a cross section block diagram of a side view of a piston with longitudinal angled ridges and grooves according to an implementation.

FIG. 3 is a cross section block diagram of a side view of a piston 300 with longitudinal angled ridges and grooves according to an implementation.

The piston 300 includes longitudinal angled ridges and grooves that are complementary to longitudinal angled ridges and grooves of the piston bore 124. The ridges are also known as threads. When the primer 204 is detonated, which in turn detonates the powder/propellant 202, thereafter the piston 302 and the payload 304 are propelled in the opposite direction of the primer 204 and out of the cartridge casing exterior 102, during which the interaction of the longitudinal angled ridges and grooves against the longitudinal angled ridges and grooves of the piston bore 124 provide a rotation and slightly lower forward velocity to the piston 300 and to the payload 304 attached thereto. The rotation provides improved stability in flight in the same way that rifling in gun barrel improves stability in flight. In one implementation, the angled ridges and grooves are a long angle (such as about 1/10 of a revolution), or perhaps as little as 5 degrees off of the longitudinal center axis) because any angle more than that might cause the motion of longitudinal angled ridges and grooves to jam against the longitudinal angled ridges and grooves of the piston bore 124 and thereby cause the entire powder/propellant 202 to detonate in the gun, which shears the ridges off of the piston and the piston bore, which releases the gasses caused by the burning of the powder/propellant 202, without imparting rotation to the piston, resulting in higher pressures in the cartridge. (No danger).

In some implementations, the second end 306 of the piston 300 has direct contact with the payload 304 or other apparatus in the payload bay (130 in FIG. 1), however the second end 306 of the piston 300 is not attached to the payload 304 or other apparatus in the payload bay (130 in FIG. 1).

In some implementations, the second end 306 of the piston 300 is directly attached to the payload 304 or other apparatus in the payload bay (130 in FIG. 1). The piston 300 also includes an upper gas seal platform 206.

FIG. 4 is a cross section block diagram of a side view of an ammunition cartridge 100, according to an implementation that includes the piston in FIG. 2 or FIG. 3.

The piston 200 in FIG. 2 or the piston 300 fit into the piston bore 124 through the second end 108 of the cartridge casing exterior 102 of the ammunition cartridge 100. The piston (200 in FIG. 2 or 300 in FIG. 3) is not coupled to the cartridge casing exterior 102.

Figure 5:
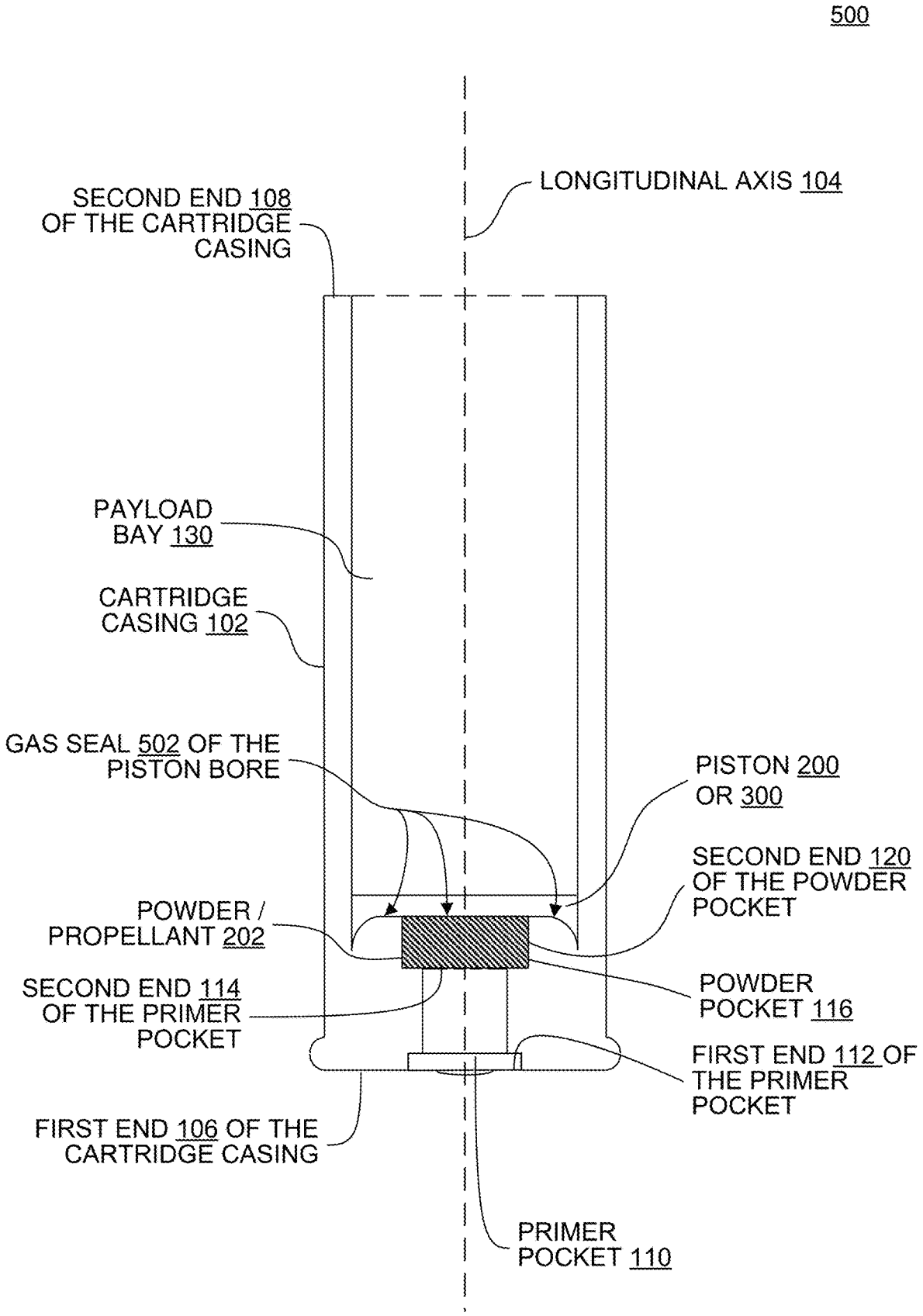
FIG. 5 is a cross section block diagram of a side view of an ammunition cartridge, according to an implementation that does not include the piston of FIG. 2 or FIG. 3.

FIG. 5 is a cross section block diagram of a side view of an ammunition cartridge 500, according to an implementation that does not include the piston of FIG. 2 or FIG. 3.

In ammunition cartridge 500, the powder pocket 116 and the powder propellant 202 extends the entire distance between the second end 114 of the primer pocket 110 and a gas seal 502 of the piston 200 or 300. The payload in the payload bay 130 is heavy enough to provide sufficient resistance to cause adequate powder propellant 202 pressure that will burn the powder propellant 202 completely.

In FIG. 1-9, pressure does not act directly against the payload bay 130, instead, the piston 200 or 300 that is in the piston bore 124 is between the powder/propellant 202 and the payload bay 130.

Figure 6:
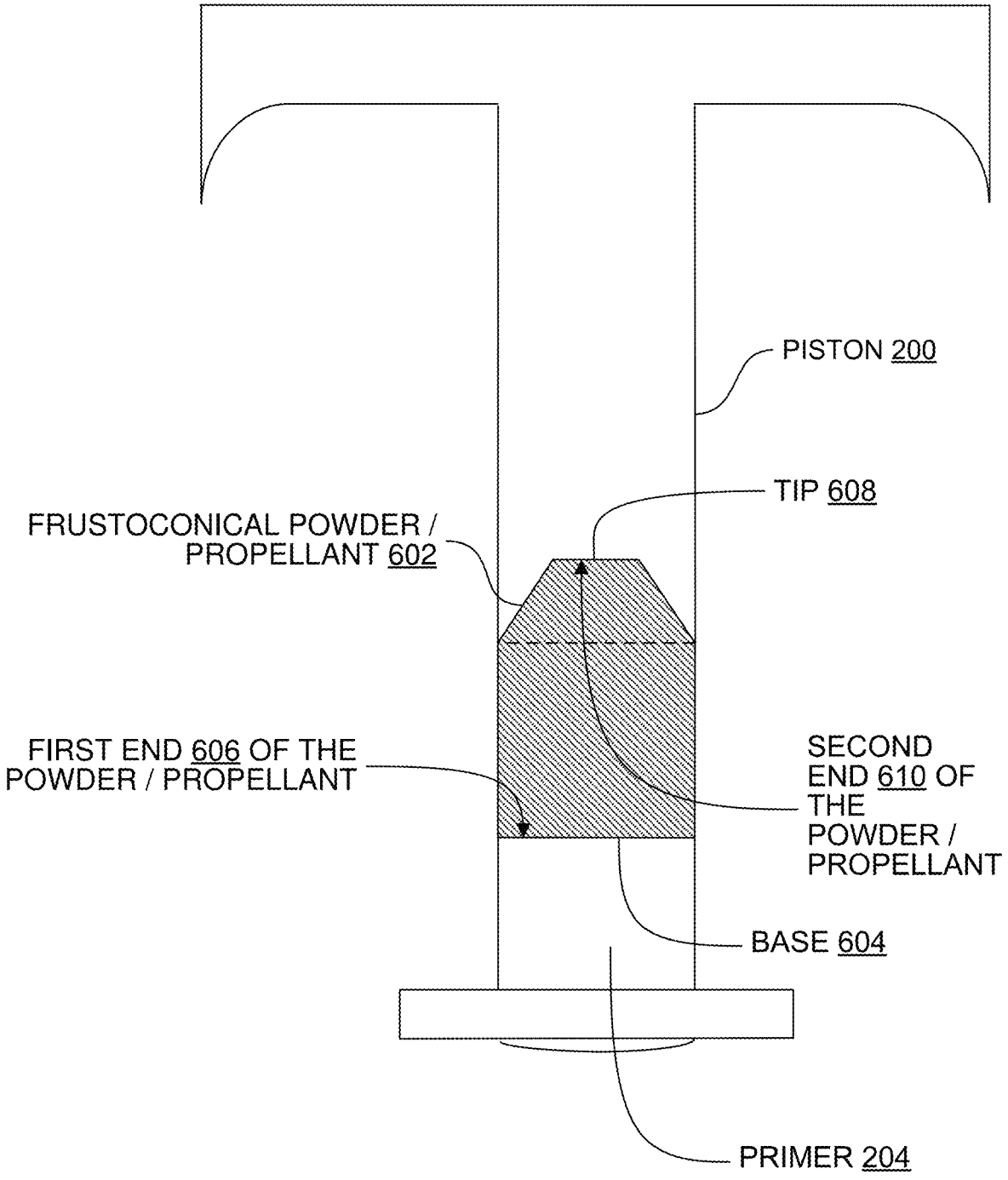
FIG. 6 is a cross section block diagram of a side view of a piston, according to an implementation in which the powder/propellant has a frustoconical geometry.

FIG. 6 is a cross section block diagram of a side view of a piston 600, according to an implementation in which the powder/propellant has a frustoconical geometry. A conical element can be in the piston base, in some embodiments. When incorporated in the cartridge base it will be hard to load in auto-equipment.

In FIG. 6, the powder/propellant 602 has a frustoconical geometry with a base 604 at a first end 606 of the powder/propellant 602 and a tip 608 at a second end 610 of the powder/propellant 602.

In some implementations, the powder/propellant 602 has a frustoconical geometry with a tip 608 at the first end 606 of the powder/propellant 202 and a base 604 at the second end 610 of the powder/propellant 202.

Figure 7:
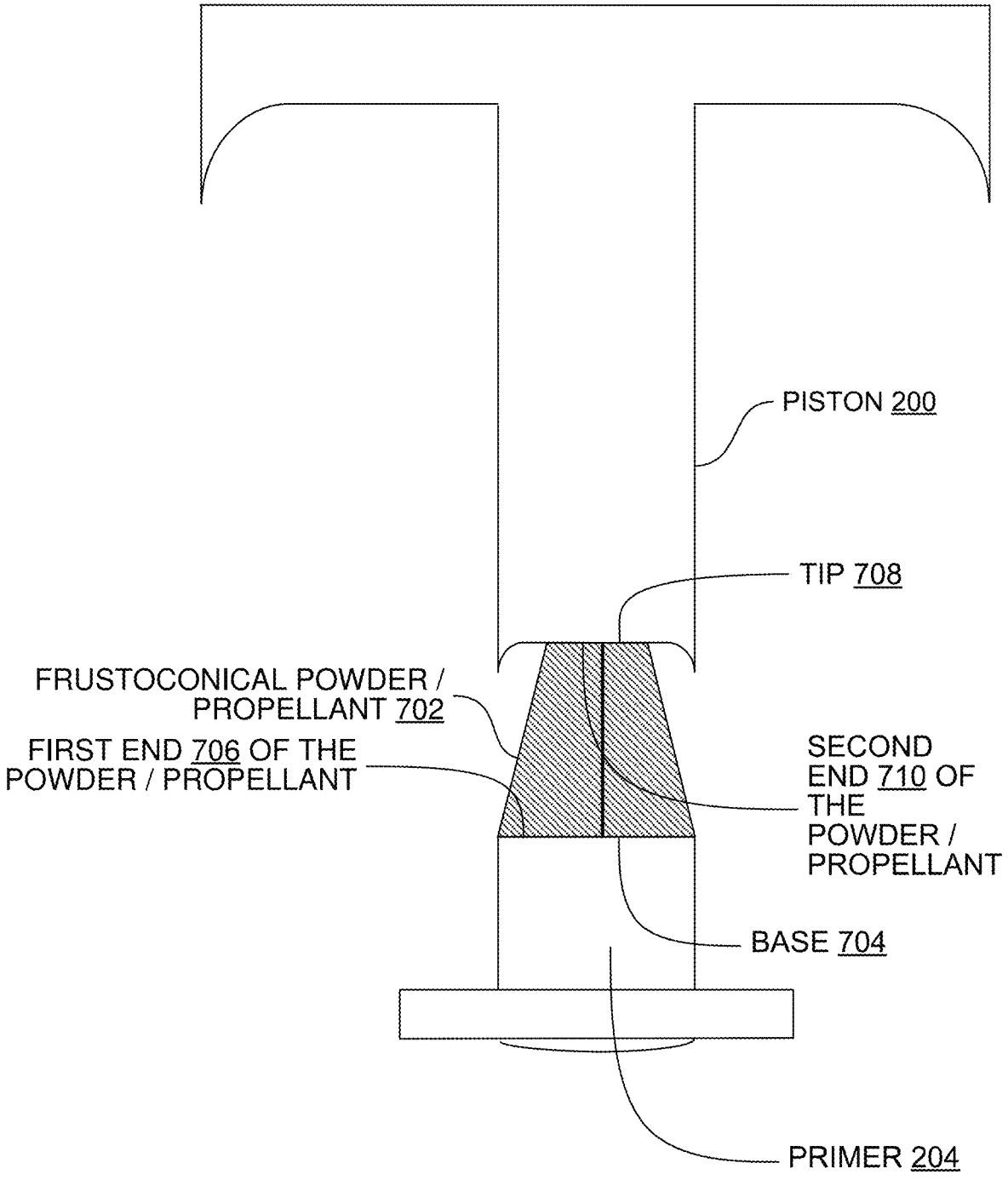
FIG. 7 is a cross section block diagram of a side view of a piston, according to an implementation in which the powder/propellant has a triangular frustum.

FIG. 7 is a cross section block diagram of a side view of a piston 700, according to an implementation in which the powder/propellant has a triangular frustum.

In FIG. 7, the powder/propellant 702 has a triangular frustum geometry with a base 704 at a first end 706 of the powder/propellant 702 and a tip 708 at a second end 710 of the powder/propellant 702.

Figure 8:
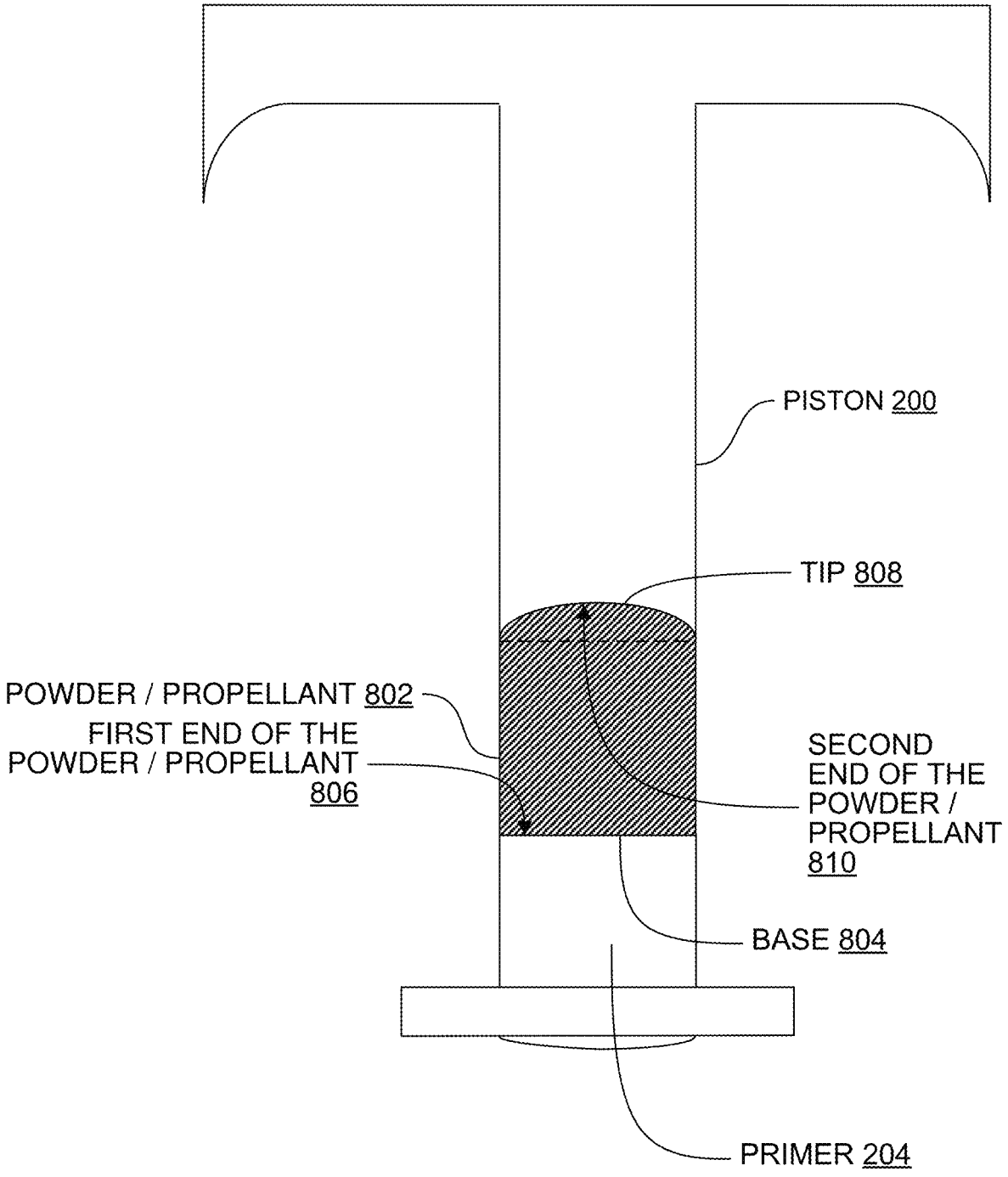
FIG. 8 is a cross section block diagram of a side view of a piston, according to an implementation in which the powder/propellant has a cylindrical geometry.

FIG. 8 is a cross section block diagram of a side view of a piston 800, according to an implementation in which the powder/propellant has a cylindrical geometry.

In FIG. 8, the powder/propellant 802 has a cylindrical geometry with a base 804 at a first end 806 of the powder/propellant 802 and a tip 808 at a second end 810 of the powder/propellant 802.

Figure 9:
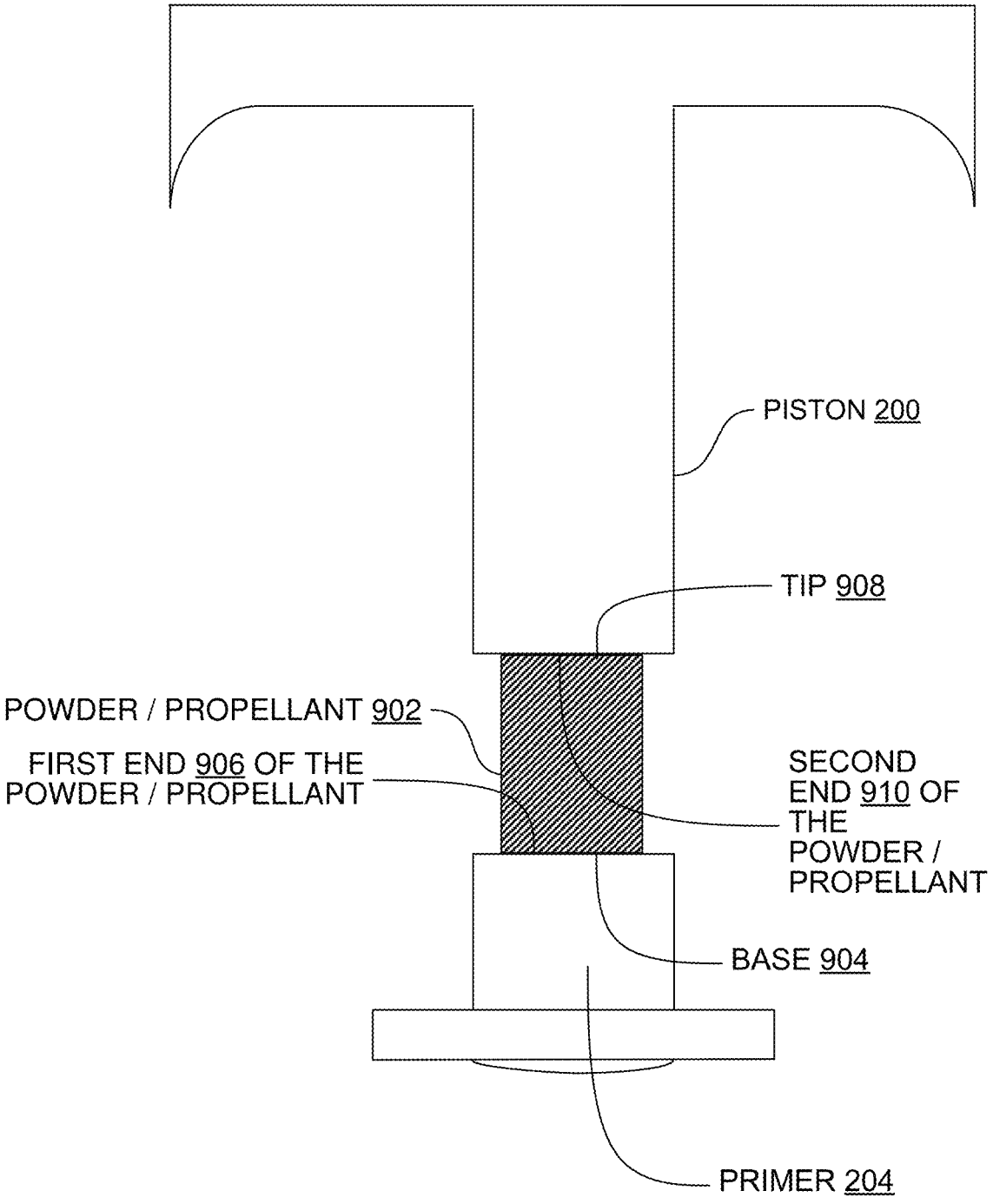
FIG. 9 is a cross section block diagram of a side view of a piston, according to an implementation in which the powder/propellant has a rectangular geometry.

FIG. 9 is a cross section block diagram of a side view of a piston 900, according to an implementation in which the powder/propellant has a square geometry.

In FIG. 9, the powder/propellant 902 has a rectangular geometry with a base 904 at a first end 906 of the powder/propellant 902 and a tip 908 at a second end 910 of the powder/propellant 902.

Figure 10:
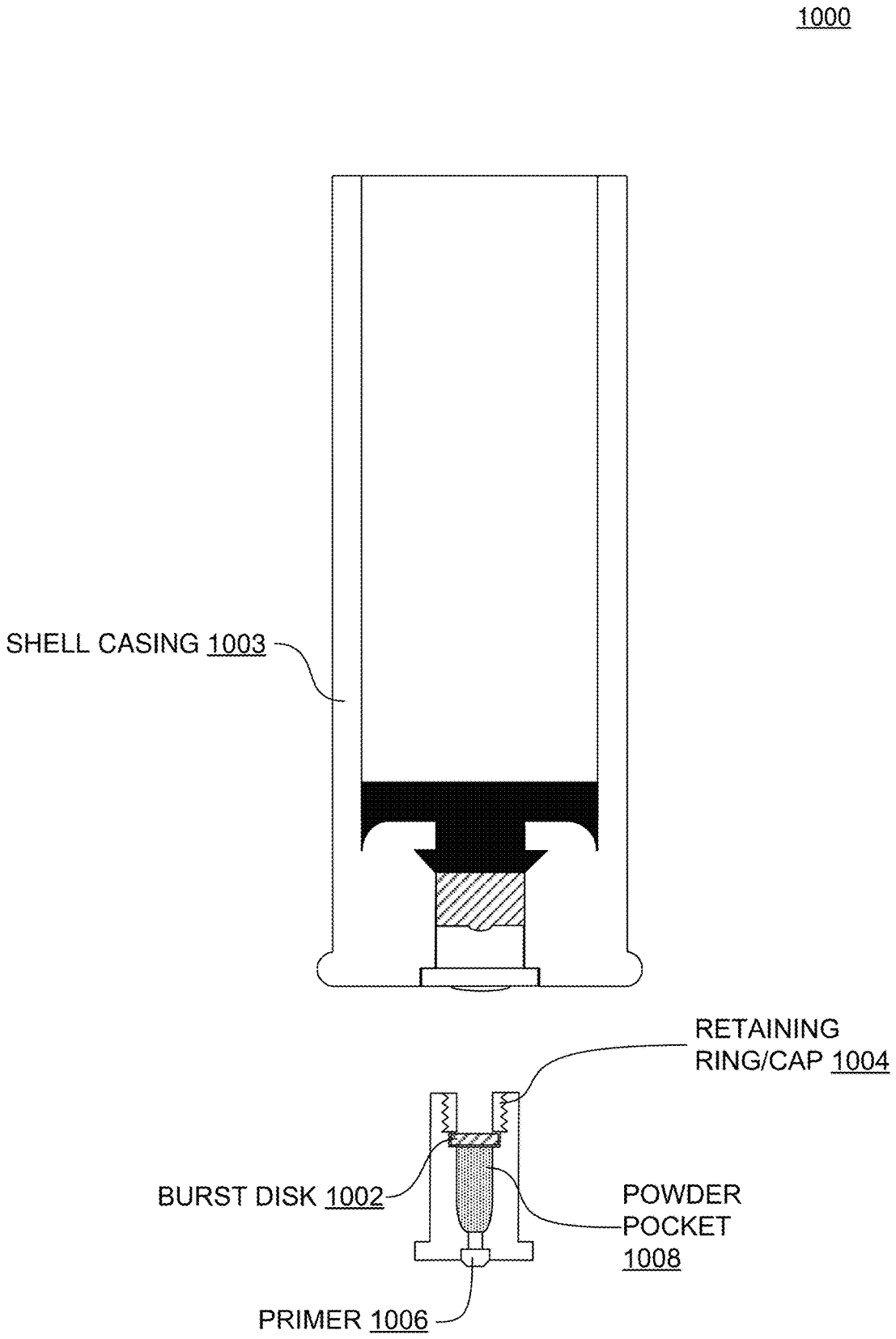
FIG. 10 is a cross section block diagram of a side view of ammunition, according to an implementation.

FIG. 10 is a cross section block diagram of a side view of ammunition 1000, according to an implementation.

In ammunition 1000, the piston is replaced with a burst disc 1002. The burst disc 1002 is retained in a shell casing 1003 by a retaining ring 1004. A scored burst disc 1002 can be designed to split into a flower-petal pattern when a primer 1006 detonates powder in a powder pocket 1008, releasing propellant gases. Ammunition 1000 provides higher pressures compared to a crimped brass shell casings, which have thin walls and are easily deformed by modest pressure. The burst disc 1002 can be constructed to burst at a specific pressure. The specific pressure of the burst provides a more uniform propulsion of payloads possible. Using the burst disc 1002 allows the ammunition 1000 to be reloadable.

Figure 11:
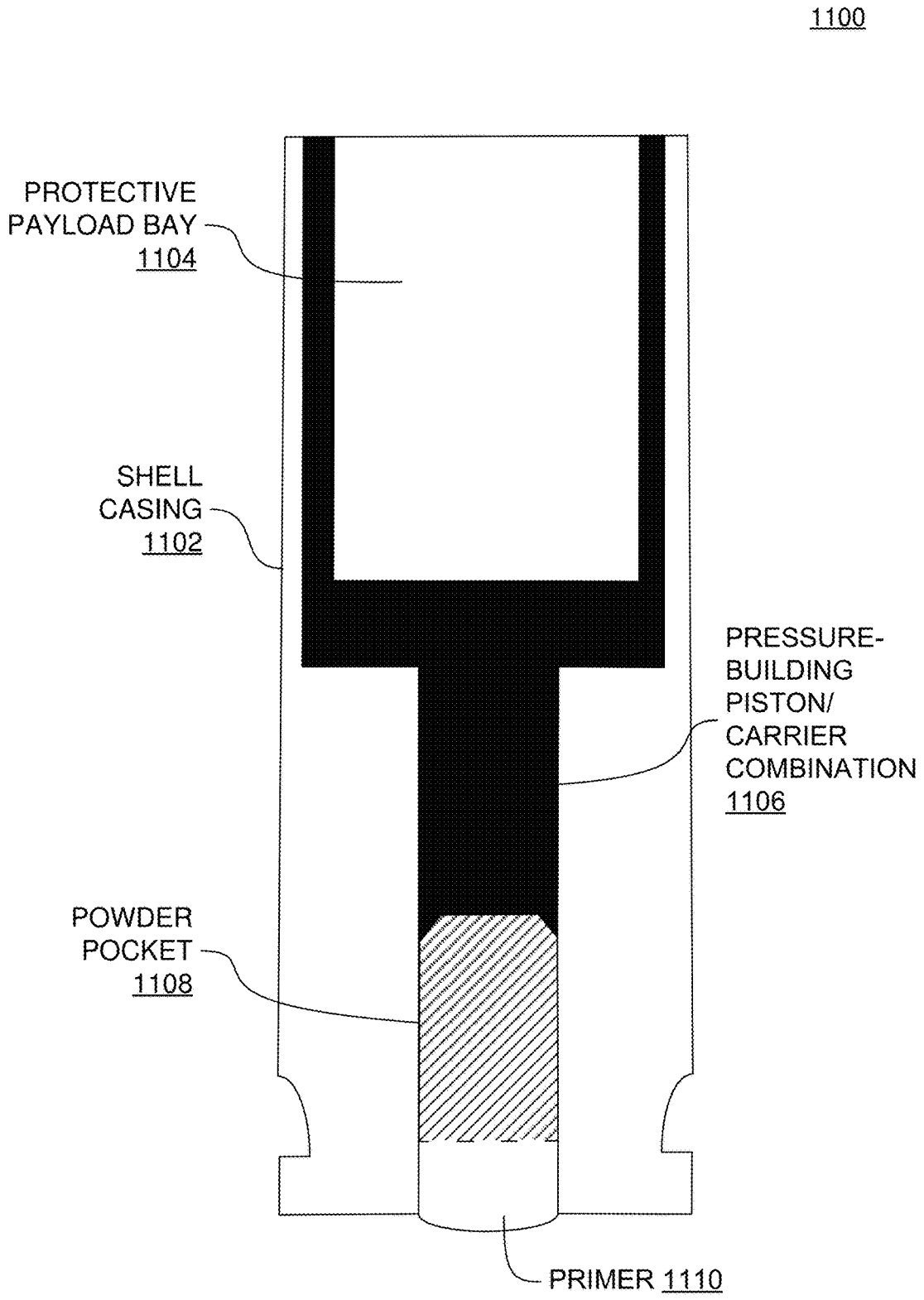
FIG. 11 is a cross section block diagram of a side view of ammunition, according to an implementation.

FIG. 11 is a cross section block diagram of a side view of ammunition 1100, according to an implementation. Ammunition 1100 implements a configuration of shell casing 1102 that is typical of automatic pistol cartridges, which shows that the structure can be used in any cartridge that is large enough to carry a desired payload in a protective payload bay 1104. The protective payload bay 1104 is adjacent to a pressure building piston/carrier combination 1106. The pressure building piston/carrier combination 1106 is adjacent to a powder pocket 1108 and the powder pocket 1108 is adjacent to a primer 1110.

Method Implementations

In the previous section, apparatus of the operation of an implementation was described. In this section, the particular methods performed by a shot gun of such an implementation are described by reference to a series of flowcharts.

Figure 12:
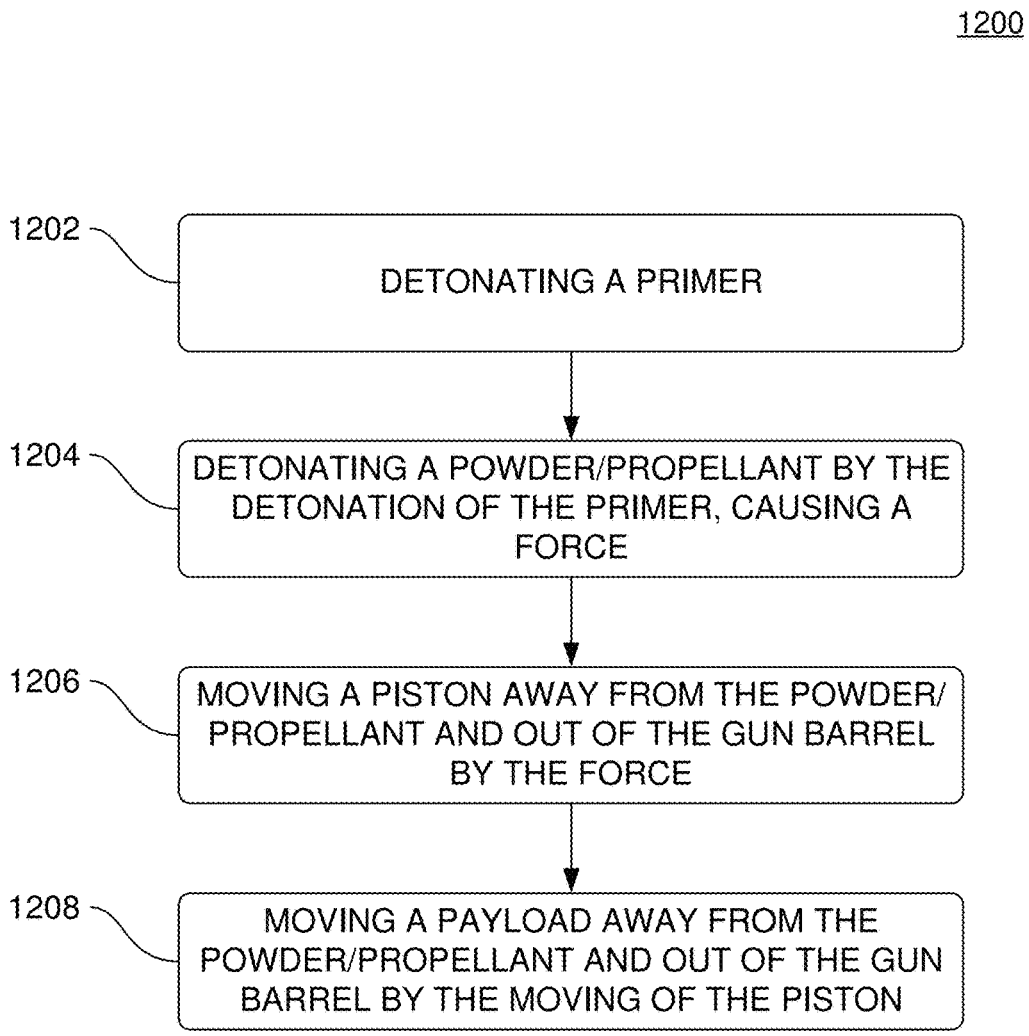
FIG. 12 is a flowchart of a method to discharge an ammunition cartridge, according to an implementation.

FIG. 12 is a flowchart of a method 1200 to discharge an ammunition cartridge, according to an implementation. Method 1200 provides payloads with drastically reduced speed that is not possible with conventional ammunition cartridge components.

Method 1200 includes detonating a primer, such as primer 204, at block 1202. The primer is in a cartridge casing, such as cartridge casing exterior 102, the cartridge casing is in a gun barrel.

Method 1200 also includes detonating a powder/propellant by the detonation of the primer, at block 1204. The powder/propellant is in the cartridge casing, the detonation causing a force. Examples of the powder/propellant include 202 in FIGS. 2-5, 602 in FIG. 6, 702 in FIG. 7, 802 in FIGS. 8 and 902 in FIG. 9.

Method 1200 also includes moving a piston away from the powder/propellant and out of the gun barrel, at block 1206. Piston 200 in FIG. 2 and piston 300 in FIG. 3 are examples of the piston. The moving of block 1206 is caused by the force, at block 1204.

Method 1200 also includes moving a payload away from the powder/propellant and out of the gun barrel, at block 1208. The moving at block 1208 is caused by the moving of the piston at block 1206, the movement of a payload being at a reduced velocity compared to conventional ammunition cartridges.

Figure 13:
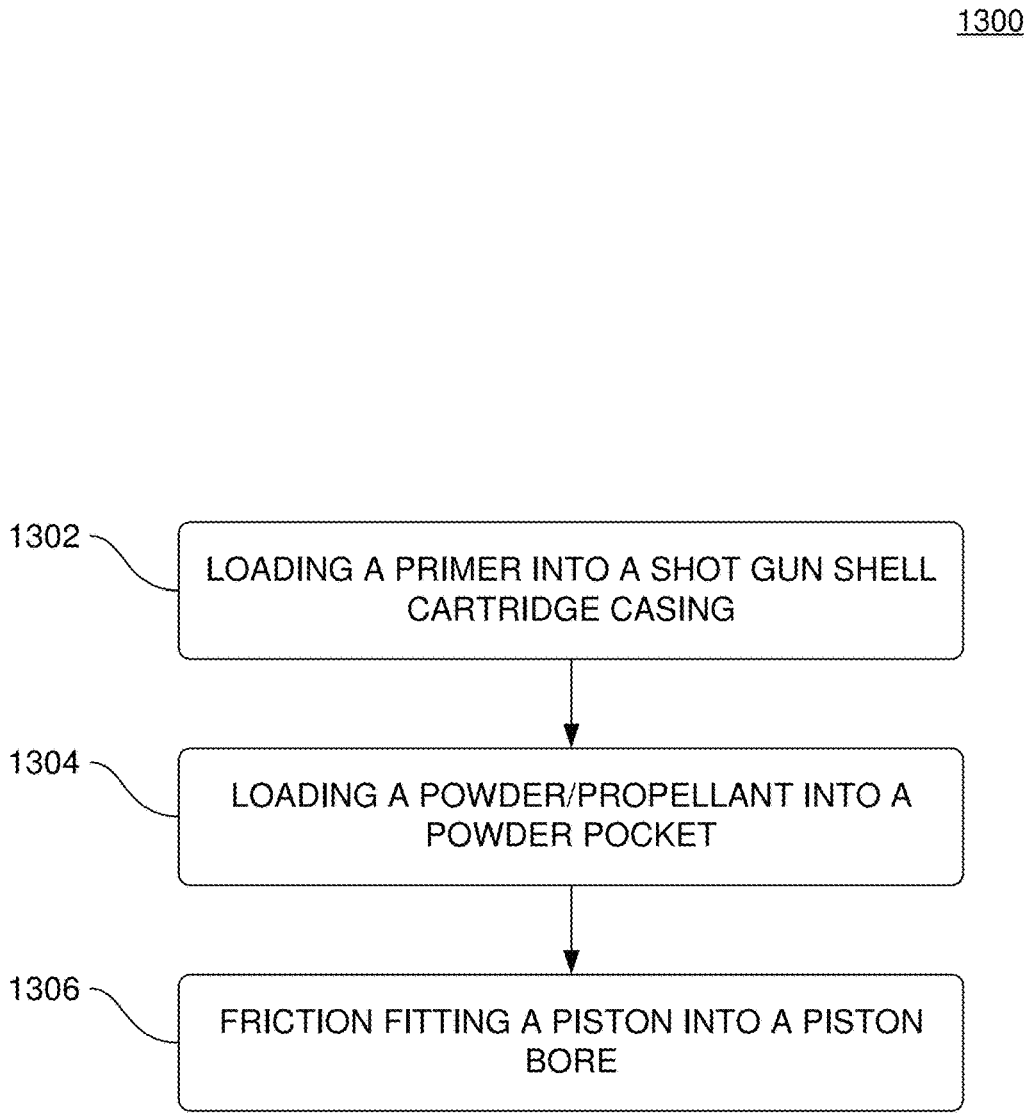
FIG. 13 is a flowchart of a method to manufacture an ammunition cartridge, according to an implementation.

FIG. 13 is a flowchart of a method 1300 to manufacture an ammunition cartridge, according to an implementation.

Method 1300 includes loading a primer into ammunition cartridge casing, at block 1302. One example of the primer is primer 204. The primer is in a cartridge casing, such as cartridge casing exterior 102, the cartridge casing is in a gun barrel.

Method 1300 also includes loading a powder/propellant into a powder pocket, at block 1304. The powder/propellant is in the cartridge casing. Examples of the powder/propellant include 202 in FIGS. 2-5, 602 in FIG. 6, 702 in FIG. 7, 802 in FIGS. 8 and 902 in FIG. 9. An example of the powder pocket is powder pocket 116 in FIG. 1.

Method 1300 also includes friction fitting a piston into a piston bore, yielding a partially loaded cartridge that is now ready to have the desired payload installed, at block 1306. The fitting is tight to keep a seal between the piston and to the piston bore to protect the powder/propellant from humidity, increasing powder bore pressure to pressures that are high enough to cause the powder to burn completely. Examples of the piston are piston 200 in FIGS. 2 and 4-9 and piston 300 in FIG. 3-9. An example of the piston bore is piston bore 124 in FIG. 1.

Figure 14:
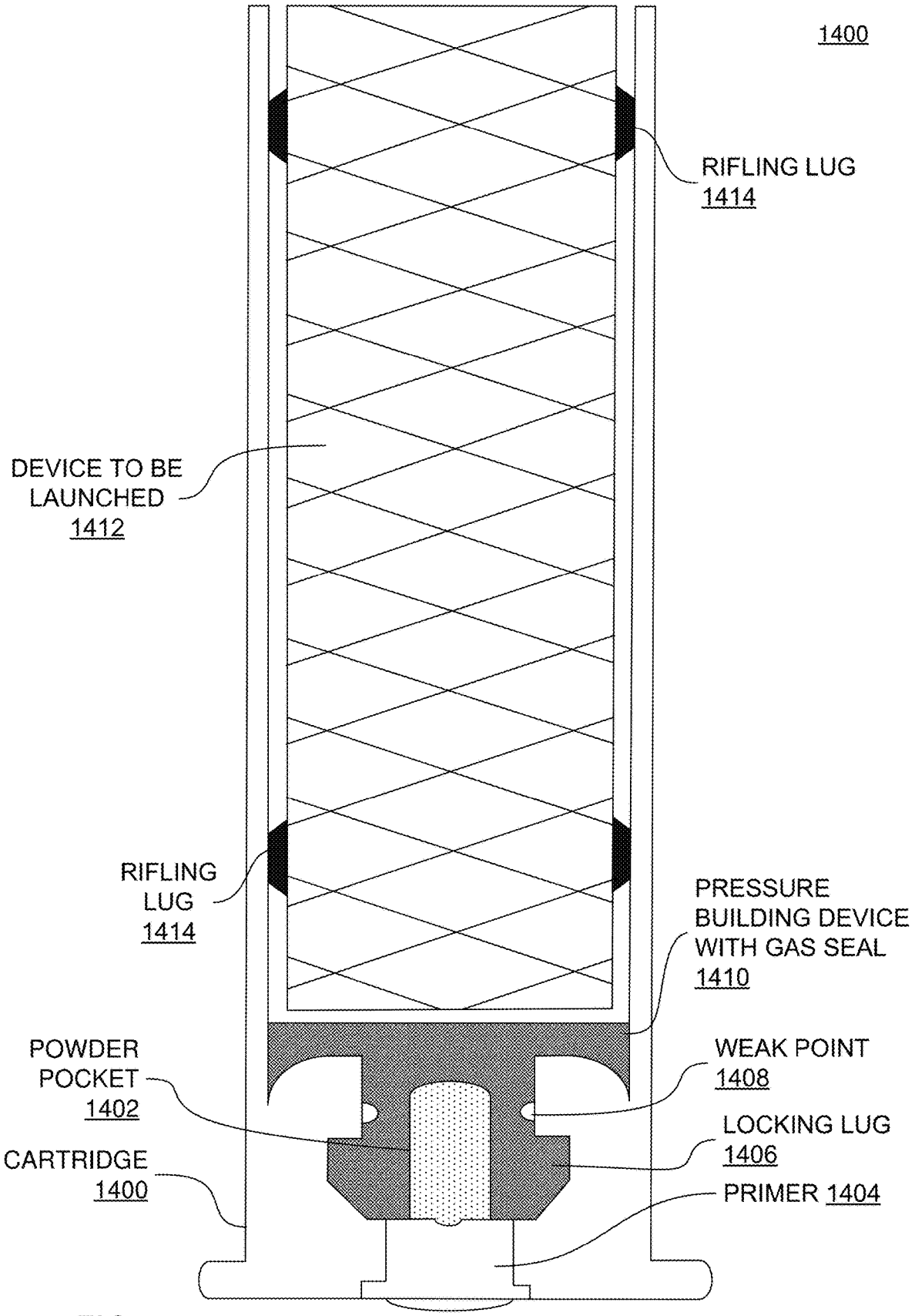
FIG. 14 is a cross section block diagram of a side view of ammunition, according to an implementation.

FIG. 14 is a cross section block diagram of a side view of an ammunition cartridge 1400, according to an implementation that does not include the piston of FIG. 2 or FIG. 3. Ammunition cartridge 1400 includes a powder pocket 1402 adjacent to a primer 1404. The powder pocket 1402 is surrounded by a locking lug 1406 on 3 sides other than the side that is adjacent side to the primer 1404. The locking lug 1406 has a circumferential weak point 1408 which is an airpocket. The ammunition cartridge 1400 includes a pressure building device with a gas seal 1410 on the side of the powder pocket 1402 that is opposite of the primer 1404. A payload bay includes a device to be launched 1412 and rifling lugs 1414 on the inside of the payload bay.

CONCLUSION

A cartridge which can be loaded to launch at much slower velocities compared to conventional shells is described. Although specific implementations are illustrated and described herein, it will be appreciated by those of ordinary skill in the art that any arrangement which is calculated to achieve the same purpose may be substituted for the specific implementations shown. This application is intended to cover any adaptations or variations. For example, although described in non-lethal terms, one of ordinary skill in the art will appreciate that implementations can be made in lethal velocity that provides the required function.

In particular, one of skill in the art will readily appreciate that the names of the methods and apparatus are not intended to limit implementations. Furthermore, additional methods and apparatus can be added to the components, functions can be rearranged among the components, and new components to correspond to future enhancements and physical devices used in implementations can be introduced without departing from the scope of implementations. One of skill in the art will readily recognize that implementations are applicable to future, different, and new primer pockets, cartridge casings, powder pockets, powder/propellants, piston bores, pistons, payload bays and payloads.

The terminology used in this application is meant to include all primer pockets, cartridge casings, powder pockets, powder/propellants, piston bores, pistons, payload bays and payloads and firearm environments and alternate technologies which provide the same functionality as described herein.

The invention claimed is:

1. An ammunition cartridge comprising:

a cartridge casing having a longitudinal center axis, a first end and a second end;

a primer pocket positioned at the first end of the cartridge casing and positioned symmetrically along the longitudinal center axis, the primer pocket having a first end and a second end, the first end of the primer pocket being positioned at the first end of the cartridge casing;

a powder pocket positioned at the second end of the primer pocket and positioned symmetrically along the longitudinal center axis, the powder pocket having a first end and a second end, the first end of the powder pocket being positioned at the second end of the primer pocket;

a piston bore positioned at the second end of the powder pocket and positioned symmetrically along the longitudinal center axis, the piston bore having a first end and a second end, the first end of the piston bore being positioned at the second end of the powder pocket;

a piston in the piston bore; and a payload bay positioned at a second end of the piston bore and positioned symmetrically along the longitudinal center axis, payload bay having a first end and a second end, the first end of the payload bay being positioned at a second end of the piston bore, the second end of the payload bay being positioned at the second end of the cartridge casing, wherein the piston is not coupled to the cartridge casing.

2. The ammunition cartridge of claim 1, wherein the piston is in direct contact with the payload bay so that pressure from powder/propellant is immediately and directly applied to the payload bay.

3. The ammunition cartridge of claim 1, wherein a diameter of the powder pocket is less than an inside diameter of the cartridge casing.

4. The ammunition cartridge of claim 1, wherein the piston further comprises:

longitudinal angled ridges and grooves.

5. The ammunition cartridge of claim 4, wherein the piston bore further comprises:

longitudinal angled ridges and grooves that are complementary to the longitudinal angled ridges and grooves of the piston.

6. The ammunition cartridge of claim 1, wherein the ammunition cartridge further comprises:

a powder/propellant in the powder pocket and the powder/propellant has a frustoconical geometry with a tip at the first end of the piston and a base at the second end of the primer pocket.

7. The ammunition cartridge of claim 1, wherein the ammunition cartridge further comprises:

a powder/propellant in the powder pocket and the powder/propellant has a triangular frustum geometry.

8. The ammunition cartridge of claim 1, wherein the ammunition cartridge further comprises:

a powder/propellant in the powder pocket and the powder/propellant has a cylindrical geometry.

9. The ammunition cartridge of claim 1, wherein the ammunition cartridge further comprises:

a powder/propellant in the powder pocket and the powder/propellant has a square geometry.

10. The ammunition cartridge of claim 1, wherein the second end of the piston has direct contact with an apparatus in the payload bay.

11. The ammunition cartridge of claim 1, wherein the second end of the piston is directly attached to an apparatus in the payload bay.

12. An ammunition cartridge comprising:

a cartridge casing having a longitudinal center axis;

a primer pocket positioned adjacent to the cartridge casing;

a powder pocket positioned adjacent to the primer pocket;

a piston bore positioned adjacent to the powder pocket;

a piston in the piston bore, the piston having a first end and a second end; and a payload bay positioned adjacent to the piston bore, wherein the piston is in contact with the payload bay so that pressure from powder/propellant is applied to the payload bay, wherein a diameter of the powder pocket is less than an inside diameter of the cartridge casing, wherein the piston is not coupled to the cartridge casing.

13. The ammunition cartridge of claim 12, wherein the piston further comprises:

longitudinal angled ridges and grooves.

14. The ammunition cartridge of claim 13, wherein the piston bore further comprises:

longitudinal angled ridges and grooves that are complementary to the longitudinal angled ridges and grooves of the piston.

15. The ammunition cartridge of claim 12, wherein the ammunition cartridge further comprises:

a powder/propellant in the powder pocket and the powder/propellant has a frustoconical geometry having a tip and a base.

16. The ammunition cartridge of claim 12, wherein the piston is in direct contact with the payload bay so that pressure from powder/propellant is immediately and directly applied to the payload bay.

17. The ammunition cartridge of claim 12, wherein a diameter of the powder pocket is less than an inside diameter of the cartridge casing.

18. The ammunition cartridge of claim 12, wherein the second end of the piston has direct contact with an apparatus in the payload bay.

* * * * *